United States Patent [19]

Betsinger

[11] Patent Number: 4,846,741

[45] Date of Patent: Jul. 11, 1989

[54] HEEL COMPENSATING STEERING ARRANGEMENT FOR HIGH SPEED BOATS

[76] Inventor: Thomas R. Betsinger, 407 Fourth Ave., South, Onalaska, Wis. 54650

[21] Appl. No.: 230,798

[22] Filed: Aug. 10, 1988

[51] Int. Cl.[4] ..... B63H 5/12; B63H 25/42

[52] U.S. Cl. ..... 440/57; 440/61; 440/63; 440/80

[58] Field of Search ..... 440/53, 57, 61, 63, 440/75, 83, 111, 112, 80; 114/280, 281

[56] References Cited

U.S. PATENT DOCUMENTS

| | | | |
|---|---|---|---|
| 4,544,362 | 10/1985 | Arneson | 440/61 |
| 4,565,532 | 1/1986 | Connor | 440/57 |
| 4,645,463 | 2/1987 | Arneson | 440/57 |
| 4,748,929 | 6/1988 | Payne | 114/280 |

OTHER PUBLICATIONS

Pre-Publication Copy of Advertisement and Short Notice, pp. 14 and 59 of *Boatracing Magazine* Series 2, vol. 45, published in the Jul. Time Frame of 1988, Exact Publication Date Unknown.

*Primary Examiner*—Sherman D. Basinger
*Assistant Examiner*—Thomas J. Brahan
*Attorney, Agent, or Firm*—William J. Beres

[57] ABSTRACT

A boat steering mechanism contemplates the disposition of parallel side-by-side drive shafts outboard of the boat's fore and aft centerline. The shafts are supported for high speed rotation by drive sleeves which are in turn supported by members attached to the transom at effectively a single universal pivot point. Such attachment of the support members to the transom allows the props at the ends of the drive shafts to swing along a shared arc in response to being driven to port or starboard by steering pistons. This enables the props to be positioned, during a turn, so that their degree of immersion in the water through which the boat is being driven remains essentially constant despite the heeling of the boat in the turn.

20 Claims, 3 Drawing Sheets

HEEL COMPENSATING STEERING ARRANGEMENT FOR HIGH SPEED BOATS

BACKGROUND OF THE INVENTION

The present invention relates to boats having inboard motors. More particularly, the present invention relates to a steering mechanism for high speed boats. With still more particularity, the present invention relates to a steering mechanism for a boat having dual drive shaft in which the props, driven by inboard motors through the drive shafts, are maintained at an essentially constant depth whether the boat is being driven staright or is heeling in a turn.

Historically, high speed motor boats having dual drive shafts and dual props are such that they tend to lose speed and skid in high speed turns. Such loss of speed and skidding occurs because previous steering arrangements have typically failed to adequately compensate for the driving of the prop on the inboard side of a turn deeper into the water and the raising of the prop on the outboard side of the turn up and sometimes out of the water as the boat heels in a turn.

Such loss of control and speed is critical and can be dangerous in situations such as races where boats operate at tremendous speeds and closed aboard one another. Steering problems are capable of being solved by steering systems which compensate for heel although no system is known which has thus far solved the problem in its entirety.

One arrangement which to some extent goes to the solution of such steering related problems can be found in U.S. Pats. Nos. 4,544,362 and 4,645,463 to Arneson. In particular, Drawing FIGS. 11 and 12 of the Arneson patents, the latter of which is a continuation of the former, together with the explanation of those figures will provide an appreciation that both of the props in the Arneson system move vertically upward or downward, as the steering mechanism is actuated, in a manner such that the relative movement of the two props in both the vertical and horizontal directions is identical.

The props move along discrete arcs defined one per each prop because each drive shaft is supported independently, at separate points on the transom, which are vertically directly above the point of connection of the respective propeller shaft carriers 30' to the transom. Therefore, as the boat is turned, the props each concurrently move vertically upward or downward along two horizontally separate arcs centered on steering axes S'-S'. See specifically column 6, lines 33-68, and column 7, lines 1-6, in the latter Arneson patent. FIG. 9 in the Arneson patents will likewise be useful in understanding the Arneson system.

While the Arneson system addresses the problems indentified above to an extent, the need continues to exist for a steering mechanism for high speed, high power, dual prop boats which to a more agressive degree compensates for the tendency of one prop to "dig in" to the water and for the opposite prop to raise out of the water as the boat heels in a turn.

SUMMARY OF THE INVENTION

It is an object of the present invention to provide a steering system for a high power, high speed, dual prop boat which compensates for the tendency of the boat to heel or lean into a turn.

It is another object of the present invention to provide a steering mechanism for high speed dual prop boats which automatically adjusts the position of the props so as to maintain both props at essentially constant depths in the water irrespective of whether the boat is unheeled, is slightly heeled in a gentle turn or is significantly heeled in a hard turn.

It is still another object of the present invention to provide a steering mechanism for a dual prop, boat having inboard motors, which mechanically adjusts the depth of each of the props in response to the degree of a turn by concurrently raising the prop which would otherwise tend to be driven deeper into the water during the turn and by effectively lowering the prop which would otherwise tend to be raised out of the water during the turn.

It is a further object of the present invention to provide a steering system for a high speed, dual prop boat which compensates for the heeling of the boat in a turn so as to minimize the loss of control, skidding and loss of speed in the turn.

It is a still further object of the present invention to provide a steering system for a high speed, dual drive shaft boat which compensates for the heeling of the boat in a turn by supporting each of the drive shafts at effectively a single location so that the props at the ends of the drive shafts are free to move and be positioned on what is effectively a single arc, centered generally inboard, forward and above the props, in accordance with and in response to the degree of the turn.

These and other objects of the present invention, which will become apparent when the following Description of the Preferred Embodiment and attached Drawing Figures are considered, are accomplished by a steering mechanism which contemplates the disposition of parallel side-by-side drive shafts outboard of the fore and aft centerline of a boat. The driveshaft are rotatably supported in drive sleeves which are in turn supported by members attached to the transom area, at a single transom location, in a ball and socket arrangement. The support members tend inboard, upward and forward from their point of attachment to the drive sleeves so as to connect to the transom of the boat at what is effectively a single universal pivot point.

The support members attach to the transom area by a ball and socket arrangement which permits the props to swing along and on a shared arc in response to being driven to the left or right by steering actuator pistons. By permitting the upper ends of the support members to rotate in three dimensions about point of attachment to the transom area, the props are able to be positioned, during a turn, so that the degree of their immersion in the water through which the boat is being driven is maintained essentially constant despite the heeling of the boat in the turn.

BRIEF DESCRIPTION OF THE DRAWING FIGURES

DESCRIPTION OF THE PREFERRED EMBODIMENT

Figure 1:
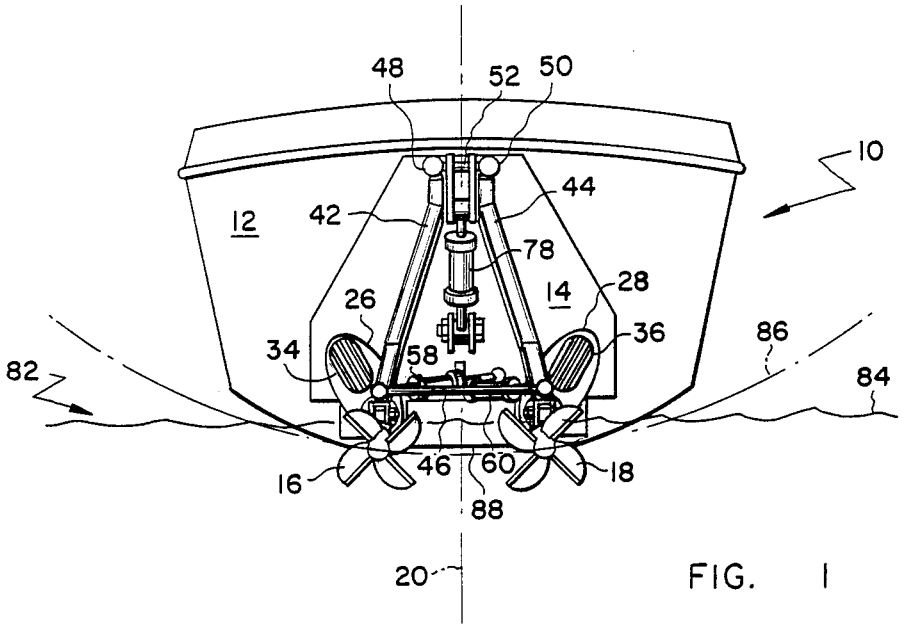
FIG. 1 is a stern (rear) view showing the transom of a boat equipped with the steering mechanism of the present invention.
Figure 2:
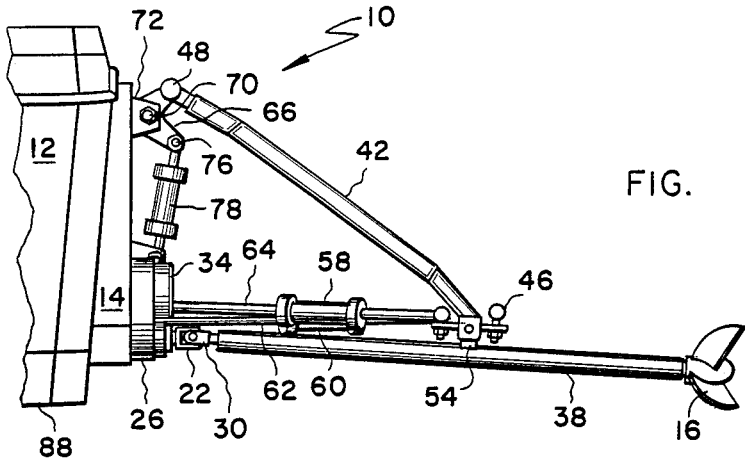
FIG. 2 is a port (left) side viiew of the stern and transom area of a boat equipped with the steering mechanism of the present invention.
Figure 3:
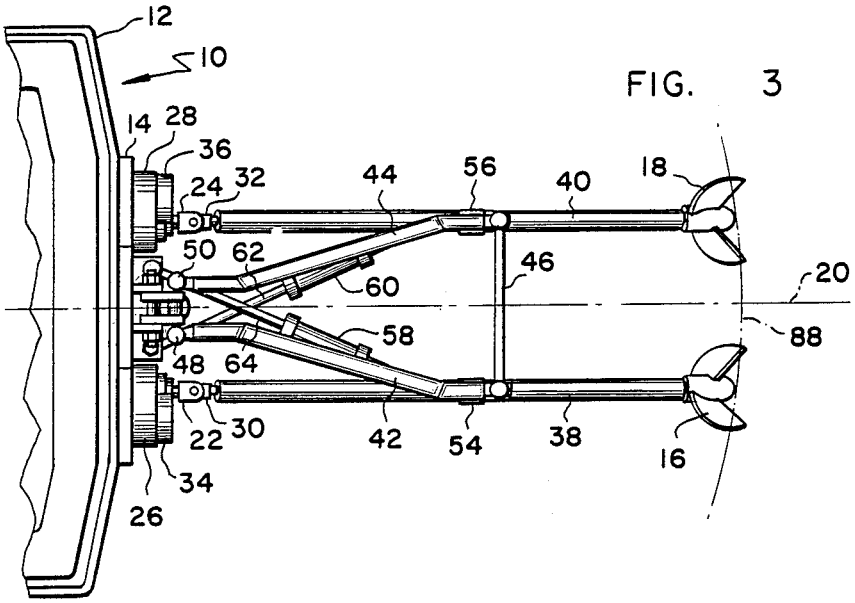
FIG. 3 is a top view of the stern and transom area of a boat equipped with the steering mechanism of the present invention.

Referring initially to FIGS. 1, 2 and 3, boat 10 has a transom area 12 located at its sterm on which is mounted a transfer casing 14. Transfer casing 14 houses mechanical power transmission apparatus including drive gears (not shown) which comprise a part of the boat's drive train. The drive train is employed to transmit power from the engines (not shown) housed within the hull of the boat so as to cause the high speed revolution of port prop 16 and starboard prop 18 which in turn drive boat 10 through the water.

The drive train by which boat 10 is driven through the water includes, in the preferred embodiment, a pair of engines (not shown) disposed within the hull of boat 10, one each on either side of the fore and aft centerline 20 of the boat. The engines drive a series of gears that ultimately cause the rotation of shafts 22 and 24 which protrude from gearboxes 26 and 28 of transfer casing 14.

Shafts 22 and 24 terminate in U-shaped or forked portions which allow for the universal coupling of shafts 22 and 24 to similar U-shaped or forked portions on port and starboard drive shafts 30 and 32. As is typical in universal type joints, the U-shaped portions of the connected shafts are at a ninety degree angle with respect to each other and are pinned together.

It will be noted that gearbox portions 26 and 28 have removable covers 34 and 36 through which access to drive gears in the drive train can be gained. This allows for the quick and convenient changing of drive gears so as to provide the abililty to quickly change drive gears to achieve alternative gear ratios if conditions so warrant. Drive shafts 30 and 32 are supported for high speed rotation within drive sleeves 38 and 40. Sleeves 38 and 40 are in turn supported by support members 42 and 44 in a manner which will further be described below.

Rod 46, is a spacer which serves to assist in the maintenance of sleeves 38 and 40 parallel to each other at all times. Rod 46 terminates at both of its ends in a ball and socket arrangement. The sockets at the ends of rod 46 envelop ball members (not shown) fixedly attached to drive sleeves 38 and 40 or alternatively to members 42 and 44. It will be appreciated that the members to which the balls and sockets are respectively attached is not critical and that their positions could be reversed with the balls being disposed at the ends of rod 46 as opposed to the sockets.

Figure 4:
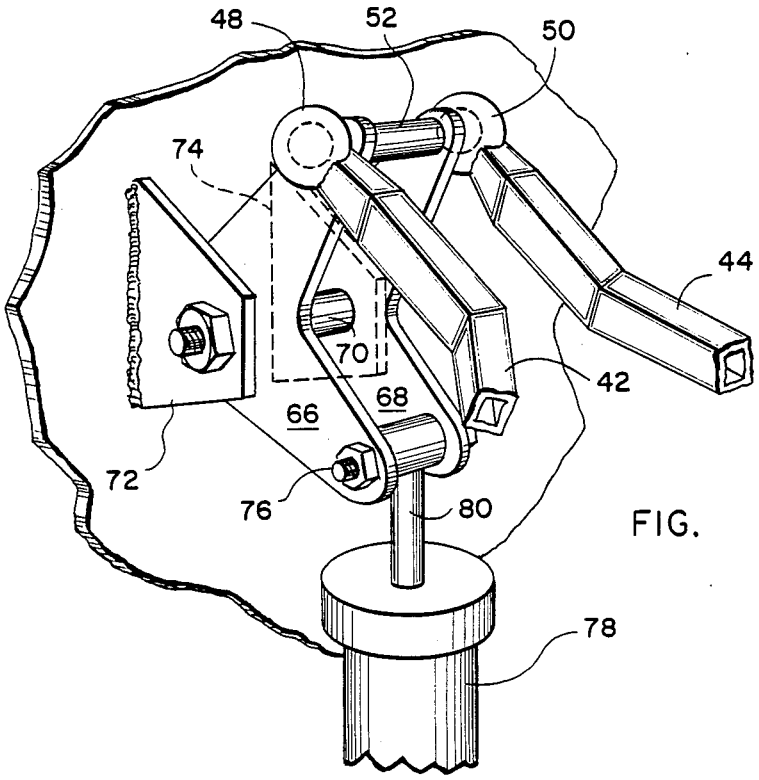
FIG. 4 is a perspective view of the transom area illustrated in FIGS. 1 through 3 which better illustrates the area of attachment of the drive sleeve support members at the transom location.

Referring additionally now to FIG. 4, support members 42 and 44 tend inboard and upward of drive shafts 30 and 32 and likewise terminate in sockets 48 and 50 which envelop balls (shown in phantom in FIG 4) that are disposed at the distal ends of shaft 52. Shaft 52 is effectively a single co-located point of connection for the support members to the boat and is located upward, inboard and forward of the point of attachment of support members 42 and 44 to the driveshaft sleeves 38 and 40 with which they are respectively associated. Port support member 42 is fixedly attached to sleeve 38 at sleeve location 54 while starboard support member 44 is fixedly attached to starboard sleeve 40 at sleeve location 56.

Hydraulically activated steering pistons 58 and 60 are pivotally attached to transom 12 and additionally to drive shaft sleeves 38 and 40 respectively in the vicinity of locations 54 and 56. Pistons 58 and 60 cross one another, as is best illustrated in FIG. 3, so to result in better mechanical effect than if uncrossed and instead were employed to act on the drive sleeve to which each is physically closest at the transom.

It will be appreciated that the greater the angle made between pistons 58 and 60 and their respective rods 62 and 64 with repect to the drive sleeve upon which they act, the greater will be the component of the force vector acting to urge the driveshaft sleeves to port and starboard effect the steering of boat 10.

Pistons 58 and 60 are preferably double acting pistons so that rods 62 and 64 are hydraulically urged both into and out of pistons 58 and 60 by the porting of pressurized hydraulic fluid to and from them. The details of the steering hydraulics are not, however, the subject of the present invention, other than peripherally.

Referring now primarily to FIGS. 2 and 4, it will be appreciated that the sockets 48 and 50 at the upward and forward terminations of support members 42 and 44 envelope balls which are at either end of a shaft 52 which, once again, offers essentially a single point connection for the support members to the transom. Shaft 52 passes through apertures defined in the upper ends of generally arcuate members 66 and 68 which are pivotally mounted on a second shaft 70. Shaft 70 penetrates members 72 and 74 which are in turn fixedly attached to transom 12 of boat 10. Members 66 and 68 are also penetrated by a third shaft 76.

A third hydraulic cylinder 78 is disposed on transom 12 for the purpose of raising and lowering drive shaft sleeves 38 and 40 and therefore, drive shafts 30 and 32 and props 16 and 18. Cylinder 78 is pivotally attached to transom 12 at its lower end and to shaft 76 at its upper end such that when rod 80 extends, members 66 and rotate about shaft 70 in a counter clockwise manner. This results in the pulling of support members 42 and 44 upward and forward so as to raise the props. The retraction of piston 80 results in the lowering of the props.

OPERATION

Referring now to all six Drawing Figures, the operation of the steering mechanism of the present invention will be appreciated. When boat 10 is being driven straight, as is illustrated in FIG. 1, props 16 and 18, which are preferably counter-rotating props, are disposed equidistant from the fore and aft centerline 20 of boat 10 and will essentially be immersed at equal depths in the body of water 82 through which boat 10 is being driven on an even keel. The center of the props will be located on a generally horizontal plane which is parallel with the surface 84 of the body of water 82.

The depth of the props is, once again, initially determined by the selective activation of cylinder 78 and rod 80. Preferably, rod 80 will be initially positioned so that a minor portion of each prop breaks the surface 84 of the water when boat 10 is being driven straight. Props 16 and 18 are of a design such that they are most effective when substantially, though not entirely, submerged.

Figure 5:
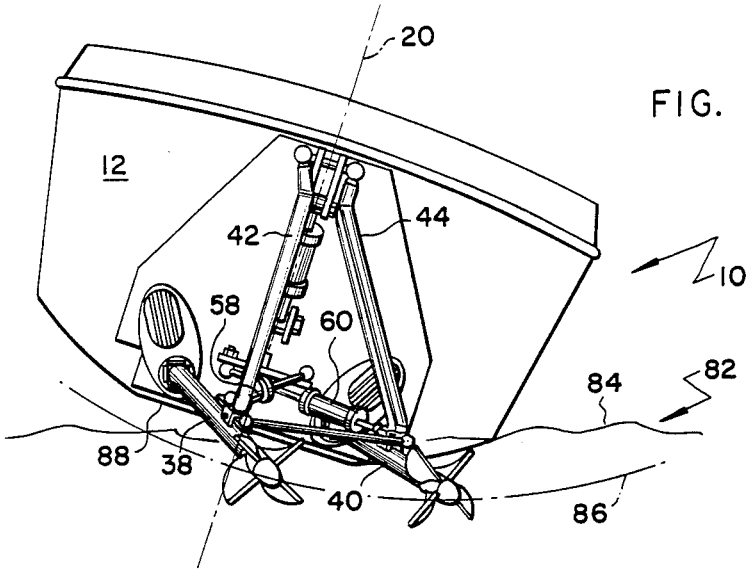
FIGS. 5 and 6 illustrate the positioning of the props of the boat in FIG. 1 in response to turns to port and starboard respectively as well as the heeling of the boat in such turns.
Figure 6:
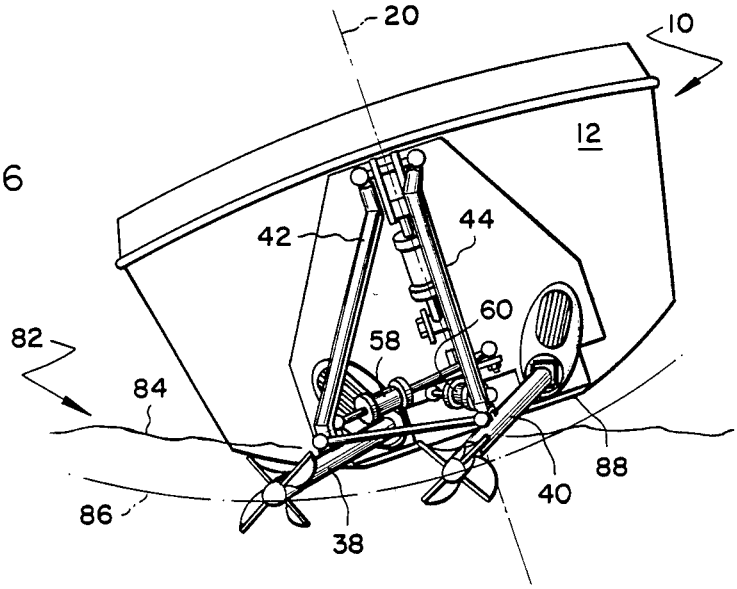

In previous steering arrangements, when turns were entered into causing a boat to heel, as illustrated in FIGS. 5 and 6, the prop on the side of the boat which was inboard of the direction of the turn, i.e. the port side in a turn to port and the starboard side in a turn to starboard, tended to be forced deeper into the body of water, reducing its effectiveness, while the outboard prop tended to be raised out of the water rendering it useless for propulsion during the turn. Or, as in the case of U.S. Pats. Nos. 4,544,362 and 4,645,463 discussed above, both props moved identically in a turn, i.e. both move vertically upward or downward along independent and discrete arcs centered vertically directly above the location where the drive shafts connect to the shafes protruding from the transom.

The steering arrangement of the present invention, on the other hand, through the use of ball and socket type joints and the concurrent movement of both props along what is effectively a single arc centered at a single point inboard and above the location where the drive shafts connect to the shafts protruding from the transom, compensates for the heeling of a boat in a turn in a manner which causes the props of a boat to be maintained at essentially constant depth irrespective of whether the boat is being driven straight or is in a hard turn. As a result, a boat equipped with the steering mechanism of the present invention tends not the lose speed or skid in a turn to the degree occassioned by the use of previous steering mechanisms.

As will be appreciated from FIG. 5, when drive sleeves 38 and 40, and therefore props 16 and 18, are driven to starboard by the selective activation of steering pistons 58 and 60, the props move to the right along arc 86. Because the centers of props 16 and 18 move along arc 86 in response to being moved to the right, port prop 16 is effectively lowered with respect to the bottom 88 of boat 10 while starboard prop 18 is effectively raised with respect thereto. Note that port prop 16 follows starboard prop 18 as prop 18 moves to the right along arc 86.

Conversely, when boat 10 is in a turn to port, as illustrated in FIG. 6, drive sleeves 38 and 40 and props 16 and 18 are driven to the left along arc 86 with starboard prop 18 following port prop 16. Because props 16 and 18 are driven to the left along arc 86 in a turn to port, port prop 16 is effectively raised with respect to the bottom 88 of boat 10 while starboard porp 18 is effectively lowered with respect thereto.

However, because boat 10 has a natural tendency to heel in the direction of a turn, props 16 and 18 are caused to remain at an essentially constant depth in the water through which boat 10 is being driven due to their positioning on arc 86 by the steering pistons and despite the heeling of boat 10 in the turn. Once again, this is because as props 16 and 18 are driven to port or starboard, boat 10 simultaneously heels to a predetermined characteristic degree which directly correlates to the degree to which the props are driven to the left or right.

Key to the understanding of the present invention is the understanding that because members 42 and 44 tend inboard and upward to what is effectively a single point of connection or support at the transom, props 16 and 18 both move along a single arc. Therefore, one prop follows the movement of the other on the arc and one prop is therefore capable of moving vertically downward on the arc while the other is moving vertically upward on the same arc at the same time.

Essentially, when both props are on the same side of centerline 21, as illustrated in FIGS. 5 and 6, both move vertically in the same direction as steering pistons 58 and 60 are actuated. When the props are one each on either side of centerline 20, they each move in a vertically different direction in response to the actuation of the steering pistons until such time as both props become located on the same side of the centerline.

It will be appreciated that by determining the degree to which boat 10 heels in response to the driving of the props to varying degrees to port or starboard at high speeds, the steering mechanism of the present invention can be mechanically set up and dimensioned without undue experimentation such that the props are maintained at an essentially constant depth in the water irrespective of whether the boat is being driven straight, is in a shallow turn or is in a sharp turn. Such set up is a matter of the specifics of individual boat design and will be accomplished without great difficulty by those skilled in the art.

According to one of the teachings of the present invention, props 16 and 18 follow each other along a single arc 86 in response to the driving of sleeves 38 and 40 to port or starboard such that as boat 10 heels to a degree determined by the sharpness of a turn, the props are positioned along arc 86 so as to be maintained at an essentially constant depth in the water.

It can be otherwise said that in response to the driving of the props to the left or rigit on arc 86, the reaction of boat 10 is to heel to a predictable degree which is in accordance with the distance the props have been moved along arc 86 by the steering pistions with the result that the props are maintained at an essentially constant depth.

The ability of the steering mechansim of the present invention to achieve the maintenance of props 16 and 18 at a constant depth is attributable to the connection of support members 42 and 44 to the transom area of boat 10 at a single location inboard, upward and forward of the locations where the drive shafts connect to the shafts protruding from the transom, in a manner which allows the props to be driven and to move along arc 86. The ability of the props to so move is, in turn, attributable to the ball and socket connection of support members 42 and 44 to the boat's transom area at effectively a single location.

The employment of ball and socket connections at this location to connect the support members to the transom area, as well as the use of ball and socket connections at the other locations discussed above, gives the steering mechanism of the present invention a degree of mechanical freedom not heretofore found in boat steering arrangements.

As will be appreciated from FIG. 3, the steering arrangement of the present invention also allows props 16 and 18 to move very slightly fore and aft on arc 88 while simultaneously being driven left or right and up or down on arc 86. Props 16 and 18 therefore undergo three dimensional movement as they are acted upon by the steering pistions whereas previous steering arrangements typically allowed for prop movement only to the left or right as well as slightly fore and aft.

Because of the additional degree of freedom offered by the steering mechanism of the present invention, which relies only on the activation of the steering pistons in order to function, props 16 and 18 of boat 10 are mechanically positioned in a manner which allows for their maintenance at an essentially constant depth according to the degree to which they are driven to the left or right on an arc 86 and in accordance with the degree of heel which results directly from their positioning on that arc.

It will be appreciated that there are many modifications which might be made to the steering mechanism of the present invention without departing from the spirit of the invention. Therefore, the scope of the present invention is to be limited only in accordance with the language of the claims which follow.

What is claim is:

1. A steering arrangement for a boat comprising:

a first drive shaft pivotally connected to said boat at a first end and having a prop at a second end;

a second drive shaft pivotally connected to said boat at a first end and having a prop at a second end;

means for maintaining said first and said second drive shafts parallel;

means for causing said first and said second drive shafts to pivot about their respective connections to said boat; and means for supporting said first and said second drive shafts so that as said first and second shafts are caused to pivot about their respective connections to said boat, the props at the ends of said first and said second drive shafts are caused to move on an arc having a center located above and between the points of pivotal connection of said first and said second drive shafts to said boat.

2. The steering arrangement according to claim 1 wherein said means for supporting said drive shafts includes a first support member connected to said first drive shaft and a second support member connected to said second drive shaft, said first and said second support members tending inboard, upward and forward of the props at the respective second ends of said drive shafts.

3. The steering arrangement according to claim 2 wherein said boat has a transom and wherein said first and said second support members connect to said boat at what is effectively a single point location proximate said transom.

4. The steering arrangement according to claim 3 wherein said first and said second support members are connected to said boat at said effectively single point location so that the ends of said first and said second support members, where they connect to said effectively single point location proximate said transom, are free to rotate in three dimensions about their respective connections at said effectively single point location.

5. The steering arrangement according to claim 4 wherein said means for supporting said drive shafts further includes a first sleeve in which said first drive shaft is housed and a second sleeve in which said second drive shaft is housed, said first support member being connected to said first sleeve and said second support member being connected to said second sleeve.

6. Apparatus for steering a boat comprising:

a first and a second prop;

first and second parallel drive shaft means, connected to said boat on opposite sides of the fore and aft axis of said boat, for transmitting a force which causes the rotation of said first and said second props;

means for causing said drive shaft means to be angularly displaced with respect to the fore and aft axis of said boat; and means for causing the vertical displacement of said first and said second props in accordance with the direction of the angular displacement of said drive shaft means, so that one of said props is displaced vertically upward and the other of said props is displaced vertically downward in response to the angular displacement of said drive shaft means.

7. The apparatus according to claim 6 where in said means for causing vertical displacement includes means connected to each of said first and second parallel drive shaft means and to said boat at a effectively a single point.

8. The apparatus according to claim 7 wherein said single point of connection of said means connected to each of said first and said second parallel drive shaft means is vertically upward and between the connections of said drive shaft means to said boat.

9. The apparauts according to claim 8 wherein the angular displacement of said force transmitting means and the vertical displacement of said props in response thereto is such that said first and said second props each move on an effectively the same arc, one prop following the other on said arc, as said force transmitting means is angularly displaced.

10. The apparatus according to claim 9 wherein means connected to each of said first and said second parallel drive shaft means and to said boat comprise a first and a second support member, said first and said second support members each being connected to said boat at said effectively single point on said boat by a ball and socket arrangement.

11. The apparatus according to claim 10 wherein said parallel drive shaft means include a first drive shaft sleeve in which a first drive shaft is supported and a second drive shaft sleeve in which a second drive shaft is supported, said first support member being rigidly connected to said first drive shaft sleeve and said second support member being rigidly connected to said second drive shaft sleeve.

12. Boat steering apparauts, comprising:

a first drive shaft, said first drive shaft having a prop at an aft end and a universal connector at a forward end by which said first shaft is connected to said boat;

a second drive shaft, said second drive shaft having a prop at an aft end and a universal connector at a forward end by which said second shaft is connected to said boat, said first and said second drive shafts being connected to said boat on opposite sides of the the fore and aft centerline of said boat;

means for maintaining said first and said second drive shafts parallel; and means for supporting said first and said second drive shafts so that the prop attached to the one of said drive shafts which is on the inboard side of a turn is displaced vertically upward and toward the direction of the turn along an arc while the prop attached to the one of said drive shafts which is on the outboard side of said turn is displaced vertically downward and toward the direction of the turn along effectively the same arc.

13. The apparatus according to claim 12 wherein said means for supporting comprises a first drive shaft sleeve in which said first shaft is rotatably supported, a second drive shaft sleeve in which said second drive shaft is rotatably supported and a pair of support members, each of said members being connected to said boat at an effectively co-located point of connection and each of said members being connected to one of said first and said second drive shaft sleeves.

14. The apparatus according to claim 13 wherein said effectively co-located point of connection is inboard and forward of said first and said second props when said drive shafts are positioned so that said props are located on opposite sides of the fore and aft centerline of said boat.

15. The apparatus according to claim 14 wherein said effectively co-located connection comprises connecting means that permit said pair of support members to rotate in three dimensions around said co-located connecting point.

16. The apparatus according to claim 15 wherein said connecting means comprises a ball and socket at the first end of each of said pair of support members.

17. The apparatus according to claim 16 wherein said apparatus further comprises means for angularly displacing said first and said second drive shafts with respect to the fore and aft axis of said boat around the the universal connectors of each of said first and said second drive shafts.

18. The apparatus according to claim 17 wherein said means for angularly displacing comprises a pair of hydraulically actuated steering pistons, said steering pistons each being pivotally connected to said boat and to one of said drive shaft sleeves, and said first and said second pistons mounted so as to cross one another.

19. The apparatus according to claim 18 wherein said means for maintaining said drive shafts parallel comprises rod means connected to each of said drive shaft sleeves by a ball and socket arrangement.

20. The apparatus according to claim 19 further comprising means for raising and lowering said props independent of said means for supporting said first and said second drive shafts.

* * * * *